US009217228B2

(12) United States Patent
Berning et al.

(10) Patent No.: US 9,217,228 B2
(45) Date of Patent: Dec. 22, 2015

(54) SELF-PROPELLED CONSTRUCTION MACHINE FOR WORKING ROADWAYS OR SURFACES AND METHOD FOR COOLING THE MILLING TOOLS OF A MILLING DRUM OF A SELF-PROPELLED CONSTRUCTION MACHINE

(71) Applicant: Wirtgen GmbH, Windhagen (DE)

(72) Inventors: Christian Berning, Brühl (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/327,668

(22) Filed: Jul. 10, 2014

(65) Prior Publication Data

US 2015/0043971 A1 Feb. 12, 2015

(30) Foreign Application Priority Data

Aug. 12, 2013 (DE) ..... 10 2013 013 304

(51) Int. Cl.
*E01C 23/00* (2006.01)
*E01C 23/088* (2006.01)
*F28C 3/00* (2006.01)

(52) U.S. Cl.
CPC ..... *E01C 23/088* (2013.01); *F28C 3/00* (2013.01)

(58) Field of Classification Search
CPC ..... E01C 23/088; F28C 3/00
USPC ..... 404/90–92, 122, 128
See application file for complete search history.

(56) References Cited

U.S. PATENT DOCUMENTS 2,424,459 A 7/1947 Hettelsater
3,980,338 A 9/1976 Weber
(Continued)

FOREIGN PATENT DOCUMENTS

DE 3102884 A1 8/1982
DE 3729088 A1 3/1989
(Continued)

*Primary Examiner* — Raymond W Addie
(74) *Attorney, Agent, or Firm* — Lucian Wayne Beavers; Patterson Intellectual Property Law, PC

(57) ABSTRACT

A self-propelled construction machine for working roadways or surfaces includes a machine frame supported by ground engaging units, and a milling drum which can rotate about an axis of rotation extending transverse to the advance direction of the construction machine. The construction machine includes a cooling device for spraying the milling tools of the milling drum with a coolant from a coolant reservoir. The cooling device is designed such that at least one coolant jet extending parallel to the axis of rotation of the milling drum is produced. A single coolant jet which extends transverse to the working direction of the milling drum is sufficient for cooling the milling tools. When the milling drum is rotating, the milling tools of the milling drum pass through the coolant jet successively. Owing to the relatively close arrangement of the milling tools in the circumferential direction of the milling drum, the time intervals in which a milling tool is not passing through a coolant jet are relatively short, and as a result the coolant consumption can be reduced.

16 Claims, 5 Drawing Sheets

(56) References Cited

U.S. PATENT DOCUMENTS

| | | | |
|---|---|---|---|
| 4,463,989 | A | 8/1984 | Kennedy |
| 5,228,369 | A | 7/1993 | Itoh et al. |
| 5,354,146 | A | 10/1994 | O'Konek |
| 5,354,147 | A | 10/1994 | Swisher, Jr. |
| 7,984,953 | B2 | 7/2011 | Gaertner et al. |
| 8,297,877 | B2 | 10/2012 | Erdmann et al. |
| 8,668,274 | B2 | 3/2014 | Gaertner et al. |
| 2001/0022919 | A1 | 9/2001 | Bruns et al. |

FOREIGN PATENT DOCUMENTS

| | | | |
|---|---|---|---|
| DE | 10007253 | A1 | 8/2001 |
| DE | 10213017 | A1 | 10/2003 |
| DE | 102011009093 | A1 | 10/2011 |
| EP | 0282381 | A1 | 9/1988 |
| WO | 2004098849 | A1 | 11/2004 |

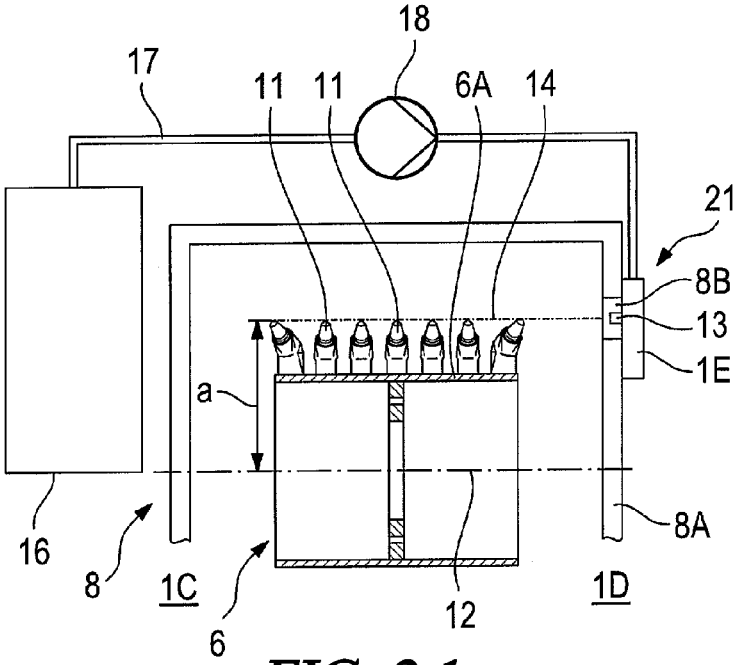
FIG. 2.1
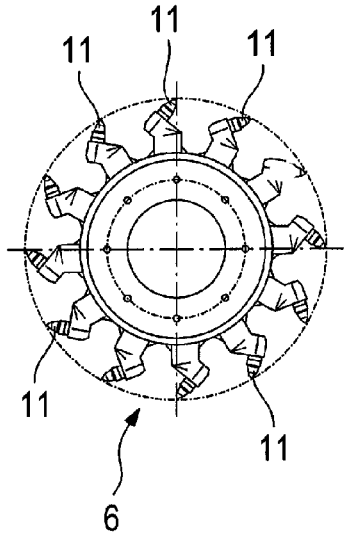
FIG. 2.2
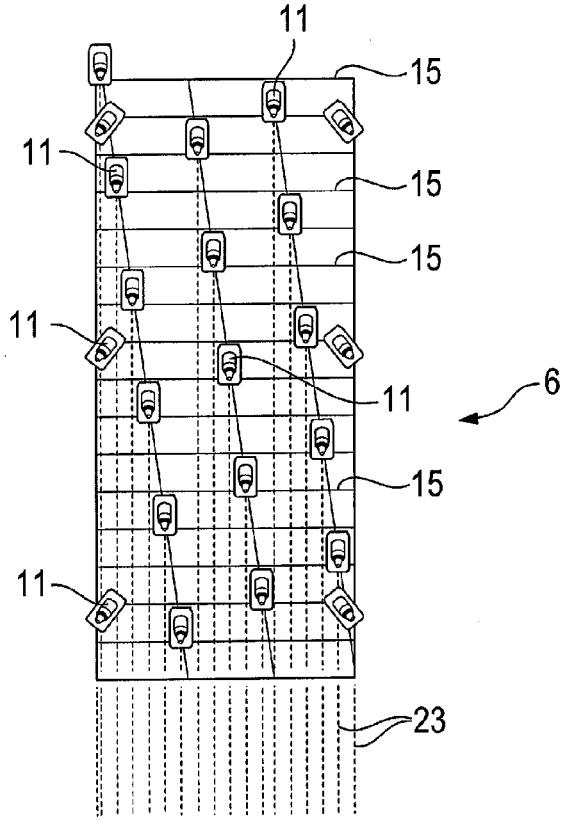
FIG. 2.3

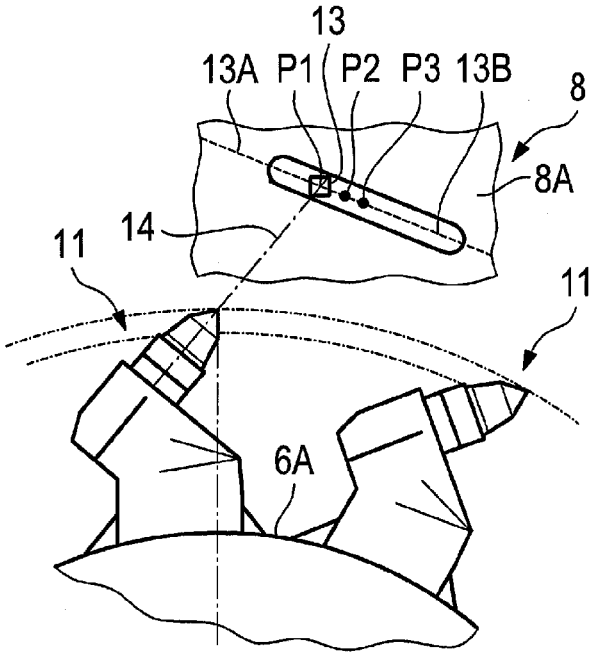
FIG. 3B.1
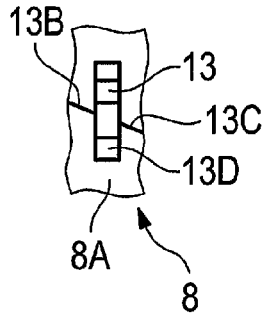
FIG. 3B.2
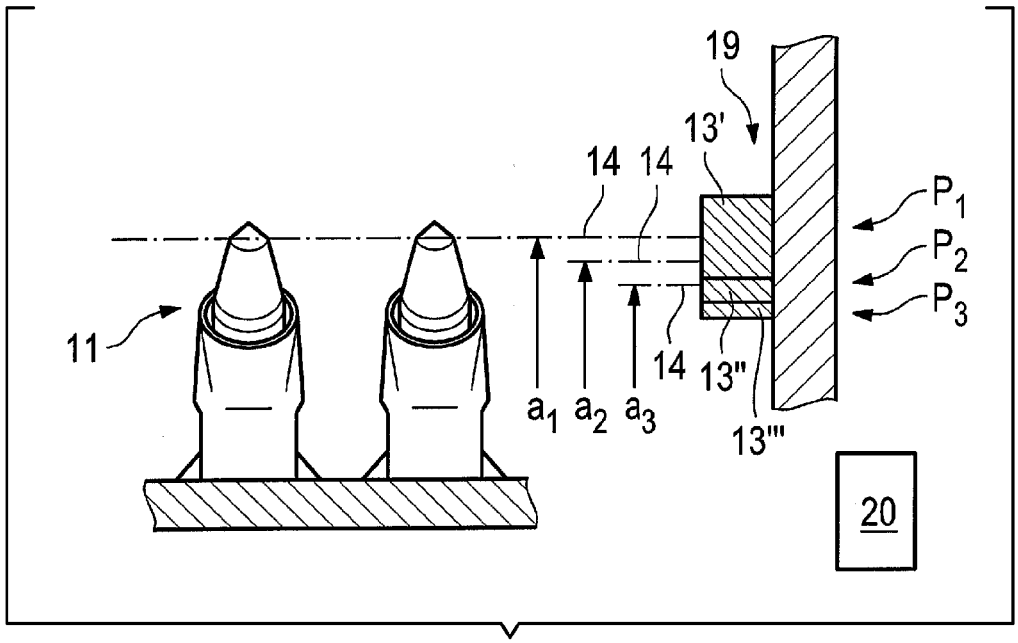
FIG. 3C

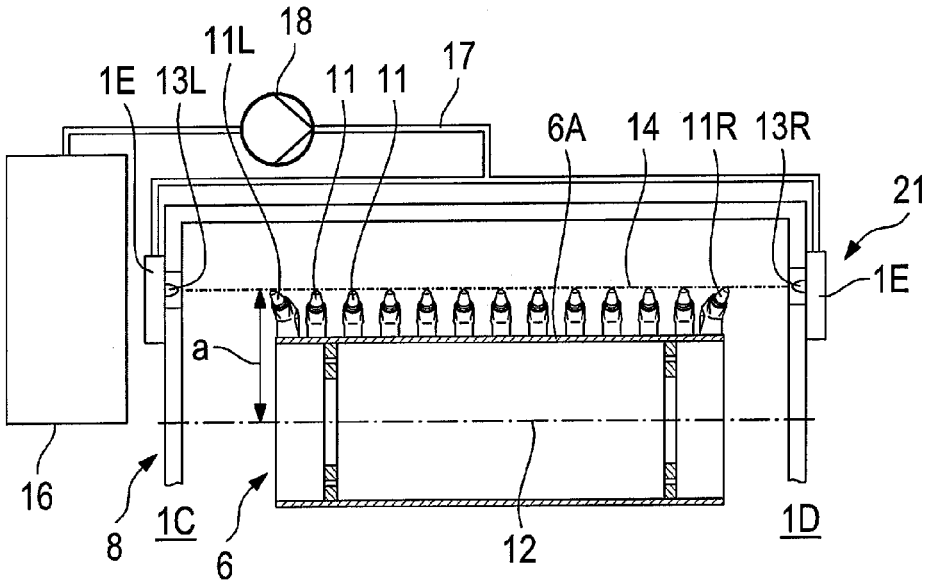
FIG. 4.1
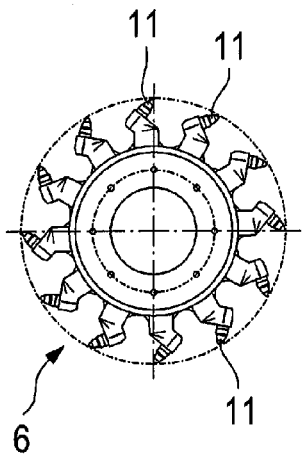
FIG. 4.2
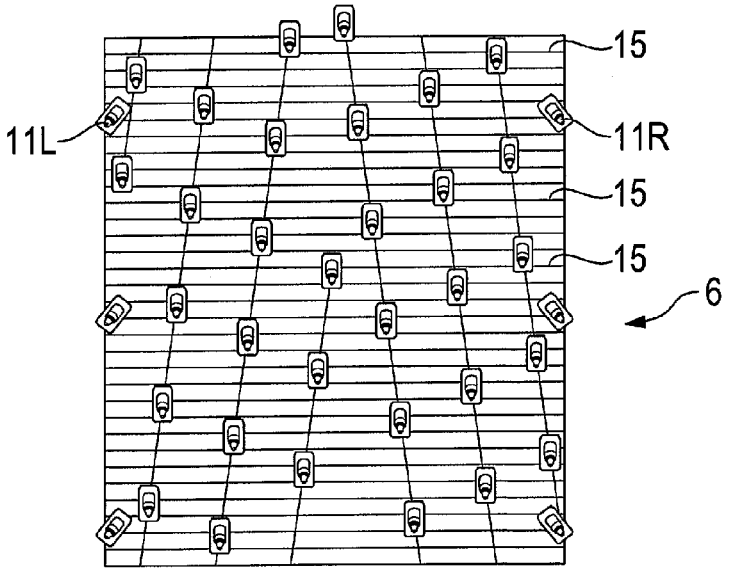
FIG. 4.3

SELF-PROPELLED CONSTRUCTION MACHINE FOR WORKING ROADWAYS OR SURFACES AND METHOD FOR COOLING THE MILLING TOOLS OF A MILLING DRUM OF A SELF-PROPELLED CONSTRUCTION MACHINE

BACKGROUND OF THE INVENTION

1. Field of the Invention

The invention relates to a self-propelled construction machine for working roadways or surfaces, comprising a machine frame supported by a crawler track and a milling drum which can rotate about an axis of rotation extending transverse to the working direction of the construction machine and is arranged on the machine frame.

2. Description of the Prior Art

Self-propelled milling machines which have a milling drum equipped with milling tools are known for working on roadways. Since the milling tools are subjected to a high level of mechanical stress, it is necessary to sufficiently cool the tools. It is known to spray the milling tools with a coolant which is provided in a coolant reservoir.

For cooling the milling tools, the known milling machines have a nozzle assembly which comprises a plurality of nozzles arranged parallel to the axis of rotation of the milling drum. The nozzles each produce a fan jet which is oriented orthogonally or tangentially to the outer surface of the milling drum. Since the individual fan jets overlap in part, a common spray jet is produced which extends over the working width of the milling drum and is directed towards the outer surface of the drum.

The known cooling devices for milling tools have proven effective in practice. However, a disadvantage is the relatively high consumption of coolant, which either makes a sufficiently large coolant tank necessary or makes it necessary for the coolant tank to be refilled during a shift. However, the enlargement of the coolant tank results in an increase in the weight of the construction machine and in an increase in the outer dimensions, whilst the need to refill the coolant tank reduces the availability of the construction machine.

DE 102 13 017 A1 (U.S. Pat. No. 7,984,952) describes a milling machine comprising a cooling device which comprises a plurality of nozzles which are arranged along an axis extending parallel to the axis of rotation of the milling drum. In order to reduce the consumption of coolant, it is proposed that the quantity of coolant added be controlled depending on a value which is characteristic of the instantaneous output of the milling drum.

The problem addressed by the invention is that of providing a construction machine having a reduced consumption of coolant for cooling the milling tools of the milling drum, so that the dimensions of the coolant reservoir can be reduced and/or the availability of the construction machine can be increased. A further problem addressed by the invention is that of providing a method for reducing the consumption of coolant for cooling the milling tools of a milling drum of a construction machine.

SUMMARY OF THE INVENTION

The construction machine according to the invention comprises a cooling device for spraying the milling tools of the milling drum with a coolant from a coolant reservoir. The cooling device is designed such that at least one coolant jet extending substantially parallel to the axis of rotation of the milling drum is produced. A single coolant jet which extends transverse to the working direction of the milling drum is sufficient for cooling the milling tools. When the milling drum is rotating, the milling tools of the milling drum pass through the coolant jet successively. Owing to the relatively close arrangement of the milling tools in the circumferential direction of the milling drum, the time intervals in which a milling tool is not passing through a coolant jet are relatively short, and as a result the coolant consumption can be reduced. However, if the jet is directed perpendicular to the outer surface of the milling drum, then a milling tool only passes the jet once per revolution, since only one tool is positioned on a circumferential line. The cooling is very efficient with the axial orientation of the coolant jet, since the milling tools pass through the coolant jet in direct succession.

The coolant jet may be designed differently, as long as the jet extends substantially parallel to the axis of rotation of the milling drum. In a preferred embodiment, the coolant jet is a full jet or a spot jet, which has a high specific jet power. However, the coolant jet may also be a fan jet having a cone shape which has a very small angle. The preferred embodiment provides that the full jet extends along an imaginary circular cylindrical outer surface on which the milling tools of the milling drum are arranged, so that the full jet directly impinges upon the milling tools. In the case of milling drums of which the milling tools are picks which have a cap-shaped pick tip, the full jet extends along the imaginary circular cylindrical outer surface on which the pick tips are arranged. The full jet preferably extends along an imaginary circular cylindrical outer surface of which the diameter is less than the cutting circle of the milling drum, so that even if the pick tips are worn, it is ensured that the full jet always impinges upon the pick tips.

One embodiment of the cooling device comprises at least one nozzle which is arranged on one of the two longitudinal sides of the machine frame beside the milling drum, such that a coolant jet extending parallel to the axis of rotation of the milling drum is produced. This embodiment is intended for milling drums in which only one milling tool, which is laterally impinged upon by the coolant jet, is arranged over the circumference of the drum along an axis which extends parallel to the axis of rotation of the milling drum.

An alternative embodiment of the cooling device provides at least one nozzle on either longitudinal side of the machine frame. This embodiment is intended for milling drums in which two milling tools are arranged on an axis extending parallel to the axis of rotation of the milling drum. The milling tool positioned on one side is sprayed by one nozzle from one side and the milling tool positioned on the other side is sprayed by the other nozzle from the other side.

The replaceable milling tools of the known milling drum are located in tool holders, which are also subject to wear. As wear of the tool holder increases, the spacing between the tip of the milling pick and the axis of rotation of the milling drum decreases. A further preferred embodiment of the invention therefore provides that the spacing between the coolant jet and the axis of rotation of the milling drum can be changed.

In a particularly preferred embodiment, the cooling device comprises a nozzle which can be adjusted to different radial spacings from the axis of rotation of the milling drum so that the coolant jet extending parallel to the axis of rotation of the milling drum can be precisely oriented towards the milling tool.

In an alternative embodiment, the cooling device comprises a plurality of nozzles which are arranged at different radial spacings from the axis of rotation of the milling drum, a valve assembly being provided to switch the individual nozzles on and off. As a result, those nozzles from which the coolant jet impinges upon the milling tool can be switched on, whilst the other nozzles can be switched off. Furthermore, a plurality of nozzles can also be switched on at the same time. The relevant nozzles can be switched on and off manually or automatically.

The cooling device preferably comprises a pressure line connecting the coolant reservoir to the at least one nozzle, a pressure pump being provided in the pressure line. The pressure pump is preferably a high pressure pump which generates a pressure that is sufficient for producing a full jet.

The coolant reservoir is preferably a coolant tank arranged on the machine frame.

However, instead of one large tank, a plurality of small tanks may also be provided.

The milling drum is preferably arranged in a drum housing, the nozzles of the coolant device preferably being arranged on the drum housing on one or both longitudinal sides of the machine frame. The nozzles are preferably arranged outside the drum housing; however, they can also be arranged inside the housing.

The method according to the invention for cooling the milling drum is characterised in that at least one coolant jet extending substantially parallel to the axis of rotation of the milling drum is produced that is directed laterally towards the milling tools. Depending on the type of milling drum, a coolant jet can be directed from only one longitudinal side of the construction machine towards the milling tools, or a coolant jet can be directed from either longitudinal side towards the milling tools. The spacing between the coolant jet and the axis of rotation of the milling drum is preferably changed depending on the wear of the milling tools.

BRIEF DESCRIPTION OF THE DRAWINGS

In the following, an embodiment of the invention is explained in detail with reference to the drawings, in which:

FIG. 2.1 is a schematic view of a first embodiment of the cooling device of the road milling machine together with the milling drum;

FIG. 2.2 is an end view of the milling drum of FIG. 2.1;

FIG. 2.3 is a developed view of the milling drum of FIG. 2.1;

FIG. 3B.1 is an enlarged view of an adjustable nozzle in relation to the milling drum;

FIG. 3B.2 is an outside elevation view of the sidewall including the adjustable nozzle of FIG. 3B.1;

FIG. 3C is an enlarged view of a nozzle assembly comprising a plurality of nozzles;

FIG. 4.1 is a schematic view of a second embodiment of the cooling device together with the milling drum;

FIG. 4.2 is an end view of the milling drum of FIG. 4.1; and

FIG. 4.3 is a developed view of the milling drum of FIG. 4.1.

DETAILED DESCRIPTION

Figure 1:
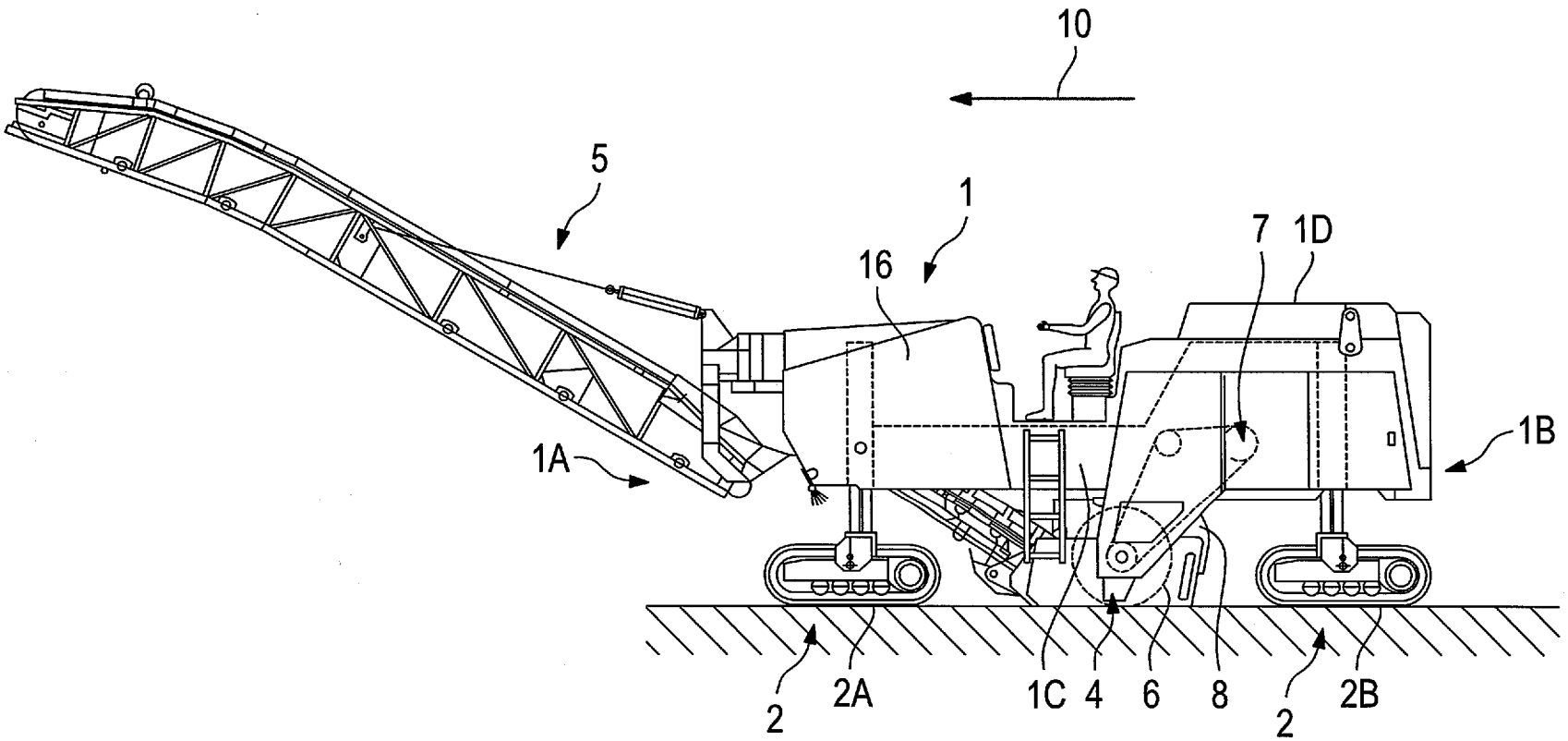
FIG. 1 is a simplified view of a road milling machine.

FIG. 1 shows the components of a road milling machine as an example of a construction machine for working roadways or surfaces which comprises a machine frame 1 and a crawler track 2. The construction machine may, however, also be a recycler or a surface miner. The crawler track 2 of the milling machine comprises four tracked crawler units 2A, 2B which are arranged on the front and rear side of the machine frame 1, which, in the direction of travel 10, has a front side 1A, a rear side 1B and two longitudinal sides 1C, 1D. The crawler track units 2A, 2B may be referred to as ground engaging units.

The road milling machine has a milling device 4 which is arranged below the machine frame 1. The material that has been milled off is carried away by a conveying device 5 arranged on the front side of the machine frame.

The milling device 4 comprises a milling drum 6 and a milling drum drive 7. The milling drum 6 is arranged in a milling drum housing 8 which surrounds the milling drum. The milling drum housing 8 is positioned below the machine frame 1 between the front and rear tracked crawler units 2A, 2B. For cooling the tools of the milling drum 6, a cooling device (not shown in FIG. 1) is provided which sprays coolant from a coolant reservoir 16 onto the tools of the milling drum. The coolant reservoir 16 may be a coolant tank arranged in front of the milling device 4 in a working direction 10.

FIG. 2.1 is a schematic view of the milling drum housing 8 together with a milling drum 6, which can be replaced with a different type of milling drum. The milling drum 6 equipped with milling tools 11 rotates about an axis of rotation 12 which extends transverse to the working or advance direction 10 of the milling machine, the milling drum extending over the working width of the machine.

Figure 3A:
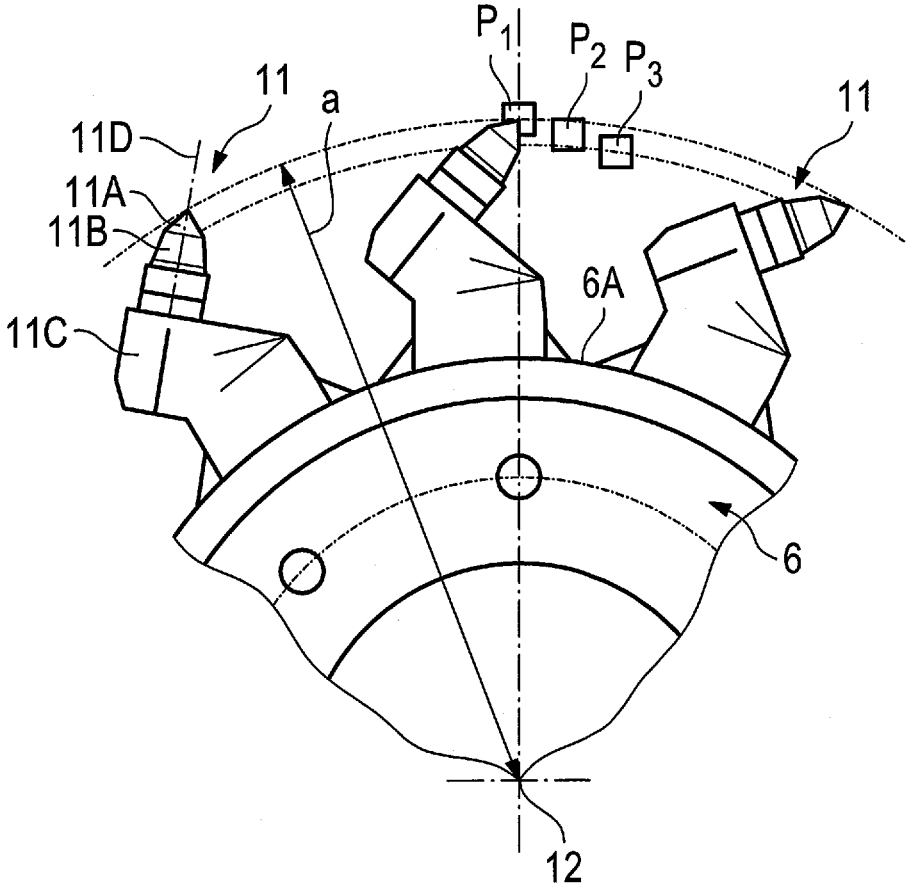
FIG. 3A is an enlarged side view of the milling tools of the milling drum from FIG. 2.

FIG. 3A is an enlarged view of the milling tools 11 of the milling drum 6. In the present embodiment, the milling tools 11, which are slanted relative to the outer surface 6A of the milling drum 6, are picks 11 which comprise a cap-shaped pick tip 11A made of particularly wear-resistant material, for example carbide or polycrystalline diamond (PCD). The pick tip 11A is rigidly connected to a pick body 11B, which is inserted into a pick holder 11C such that it can be replaced. During operation of the milling machine, the pick 11 and more particularly the pick tip 11A are subjected to a high level of wear. Therefore, the picks 11 are regularly replaced. The pick holders 11C are also subjected to wear. The wear of the pick holders 11C results in the pick tip 11A being displaced radially inwards along the axis 11D of the pick. As a result, the spacing a between the pick tip 11A and the axis of rotation 12 of the milling drum 6 decreases. However, this wear takes place over a relatively much longer period of time, so that the pick holders do not have to be constantly replaced.

In the embodiment in FIG. 2.1, the cooling device 21 has a nozzle 13 which is arranged on a longitudinal side 1C, 1D of the machine frame 1 beside the milling drum 6 on the milling drum housing 8. The nozzle 13, which is attached to a part 1E of the machine frame 1 at the level of the milling tools 11 or can also be directly attached to the milling drum housing, produces a coolant jet 14 extending parallel to the axis of rotation 12 of the milling drum 6 which laterally impinges upon the pick tips 11A of the milling picks 11 of the rotating milling drum 6 which move through the coolant jet. The nozzle 13 can be located in a recess 8B in the side wall 8A of the milling drum housing 8.

FIG. 2.3 shows a development of the milling drum 6 comprising the milling picks 11. The cooling device 21 in FIG. 2.1 is intended for a type of milling drum in which only one milling pick 11 is ever arranged on an axis 15 extending parallel to the axis of rotation 12 of the milling drum 6. As a result, the coolant jet can successively impinge upon all the milling picks, which pass through the coolant jet in direct succession in a short period of time. The consumption of coolant is therefore relatively low.

A single coolant jet 14 is sufficient to sufficiently cool the milling pick 11. The coolant jet is preferably a full jet.

A plurality of coolant jets can also be arranged at different diameters and/or can be distributed over the circumference in order to improve the cooling. In order to achieve comparable cooling performance with radially oriented nozzles, however, a distinctly higher number of nozzles is required. For example, in the case of radial orientation of the jets in the embodiment in FIG. 2.3, radially directed jets 23 are required to cool all the milling tools 18.

The coolant is provided in a coolant tank 16. A coolant line 17 leads from the coolant tank 16 to the nozzle 13. The pressure required for the nozzle 13 is generated by a high-pressure pump 18 which is provided between the coolant tank 16 and the nozzle 13.

As wear of the tools holders 11C increases, it may be necessary to reduce the spacing a between the coolant jet 14 and the axis of rotation 12, so that the coolant jet 14 always impinges upon the pick tips 11A of the milling pick 11.

In one embodiment, the nozzle 13 is displaceably arranged, it being possible to adjust the nozzle into different positions $P_1$, $P_2$, $P_3$. FIG. 3B.1 is a simplified view of an embodiment comprising an adjustable nozzle 13. The nozzle 13 can be displaced in an elongate hole 13B on an axis 13A which is slanted relative to the milling tools 11, which hole is provided in a side wall 8A of the milling drum housing 8 or on a part of the machine frame 1. FIG. 3B.2 is a view of the outside of the side wall 8A of the drum housing 8. The nozzle 13 is attached to a nozzle holder 13C, which can be attached to the side wall 8A of the drum housing 8 in the different positions, for example in the positions $P_1$, $P_2$, $P_3$, by means of a locking screw 13D (only shown schematically). By displacing the nozzle 13 in the elongate hole 13B, the radial spacing a from the axis of rotation 12 of the milling drum 6 can be precisely set to the correct position. The elongate hole 13B can also describe a curve. It is also possible for the nozzle 13 to be displaceably guided on an axis extending orthogonally to the outer surface 6A of the milling drum 6.

An alternative embodiment provides a nozzle assembly 19 instead of a single displaceably guided nozzle, which assembly comprises a plurality of rigidly arranged nozzles 13', 13", 13'". FIG. 3C is a simplified schematic view of the nozzle assembly 19 comprising the nozzles 13', 13", 13'" and the milling picks 11. The nozzles are arranged such that the spacing $a_1$, $a_2$, $a_3$ between the coolant jets 14 and the axis of rotation 12 corresponds to the wear situation of the tool holder 11C. In order to switch the supply of coolant to the individual nozzles 13', 13", 13'" on and off, a valve assembly 20 (only shown schematically) is provided which can be controlled by a control unit.

FIGS. 4.1-4.3 show an alternative embodiment of the cooling device 21, which is intended for a different type of milling drum. This embodiment, which is also suitable for the type of milling drum in FIGS. 2.1-2.3, differs in that a nozzle 13L, 13R is arranged beside the milling drum 6 on the milling drum housing 8 both on the longitudinal side 1D of the machine frame 1, which is on the right in the working direction 10, and on the longitudinal side 1C of the machine frame, which is on the left in the working direction. Corresponding parts are provided with identical reference numerals. In this embodiment, the pressure line 17 leads to both nozzles 13L, 13R, which each preferably produce a full jet which can extend on a common axis extending parallel to the axis of rotation 12 of the milling drum 6.

The milling drum 6 in FIGS. 4.1-4.3 has double the working width of the milling drum in FIGS. 2.1-2.3. For the type of milling drum in FIGS. 4.1-4.3, the milling picks 11 are arranged over the circumference such that each two milling picks 11 lie on an axis 15 which extends parallel to the axis of rotation 12 of the milling drum 6. In FIGS. 4.1 and 4.3, two milling picks which lie on a common axis 15 are provided with the reference numerals 11L and 11R. When the milling drum is rotating, the coolant jet 14 from the right-hand nozzle 13R impinges upon the right-hand milling pick 11R and the coolant jet from the left-hand nozzle 13L impinges upon the left-hand milling pick 11L. As a result, two milling picks are always cooled at the same time.

The two nozzles 13L, 13R of the cooling device 21 in FIGS. 4.1 and 4.3 may be adjustable nozzles (FIGS. 3B.1-3B.2) or may be nozzles of a nozzle assembly 19 comprising a plurality of fixed nozzles 13', 13", 13'" (FIG. 3C).

The invention claimed is:

1. A self-propelled construction machine for working roadways or surfaces, comprising:

a machine frame;

front and rear ground engaging units supporting the machine frame;

a milling drum supported from the machine frame and rotatable about an axis of rotation, the milling drum including a plurality of milling tools distributed around a circumference of the milling drum;

a drum drive operably associated with the milling drum;

a coolant reservoir; and at least one coolant nozzle connected to the coolant reservoir, the coolant nozzle being oriented to produce at least one coolant jet extending substantially parallel to the axis of rotation of the milling drum to spray the milling tools.

2. The construction machine of claim 1, wherein the at least one nozzle is configured such that the jet is a full jet, and the jet extends substantially along an imaginary cylindrical outer surface intersecting the milling tools.

3. The construction machine of claim 2, wherein:

the milling tools comprise picks each including a cup-shaped pick tip, and the imaginary cylindrical outer surface intersects the pick tips.

4. The construction machine of claim 1, wherein:

the machine frame includes left and right longitudinal sides, and the at least one nozzle is arranged on at least one of the longitudinal sides beside the milling drum.

5. The construction machine of claim 4, wherein:

the at least one nozzle includes two nozzles, one nozzle being arranged on each of the longitudinal sides beside the milling drum.

6. The construction machine of claim 1, wherein:

the at least one nozzle is adjustable to different radial spacings from the axis of rotation of the milling drum.

7. The construction machine of claim 1, wherein:

the at least one nozzle includes a plurality of nozzles rigidly arranged at different radial spacings from the axis of rotation of the milling drum.

8. The construction machine of claim 7, further comprising:

a valve assembly configured to switch the individual nozzles of the plurality of nozzles on and off.

9. The construction machine of claim 1, further comprising:

a pressure line connecting the coolant reservoir to the at least one nozzle; and a pressure pump connected in the pressure line.

10. The construction machine of claim 1, wherein the coolant reservoir comprises a coolant tank arranged on the machine frame.

11. The construction machine of claim 1, wherein the milling drum is arranged in a drum housing.

12. A method of cooling milling tools of a milling drum of a self-propelled construction machine for working roadways or surfaces, the method comprising:

moving the construction machine in a working direction;

rotating the milling drum about an axis of rotation extending transverse to the working direction of the construction machine; and spraying the milling tools with at least one coolant jet of coolant from a coolant reservoir, the at least one coolant jet extending substantially parallel to the axis of rotation of the milling drum.

13. The method of claim 12, wherein the at least one coolant jet is a full jet extending substantially along an imaginary cylindrical outer surface intersecting the milling tools.

14. The method of claim 12, wherein the at least one coolant jet extends from only one lateral side of the construction machine.

15. The method of claim 12, wherein:

the construction machine includes left and right lateral sides; and the at least one coolant jet includes left and right coolant jets directed toward the milling tools from the left and right lateral sides, respectively, of the construction machine.

16. The method of claim 12, further comprising:

changing a radial spacing of the at least one coolant jet from the axis of rotation of the milling drum depending on a state of wear of the milling tools.

* * * * *